US006539595B1

(12) United States Patent
Benedict

(10) Patent No.: US 6,539,595 B1
(45) Date of Patent: Apr. 1, 2003

(54) NON-INERTIAL RELEASE SAFETY RESTRAINT BELT BUCKLE SYSTEM

(76) Inventor: Charles E. Benedict, 3207 Remington Run, Tallahassee, FL (US) 32312

( * ) Notice: Subject to any disclaimer, the term of this patent is extended or adjusted under 35 U.S.C. 154(b) by 0 days.

(21) Appl. No.: 09/893,580

(22) Filed: Jun. 29, 2001

(51) Int. Cl.[7] ..... A44B 11/26
(52) U.S. Cl. ..... 24/633; 24/625
(58) Field of Search ..... 24/633, 625, 614, 24/615; 280/801.1, 808; 297/487

(56) References Cited

U.S. PATENT DOCUMENTS

| | | | | |
|---|---|---|---|---|
| 2,393,178 A | | 1/1946 | Manson | |
| 2,641,813 A | | 6/1953 | Loxham | |
| 2,668,997 A | | 2/1954 | Irvin et al. | |
| 3,132,399 A | | 5/1964 | Cooper | |
| 3,179,992 A | * | 4/1965 | Murphy, Sr. | 24/638 |
| 3,473,201 A | | 10/1969 | Hopka et al. | |
| 3,523,341 A | | 8/1970 | Spires | |
| 3,639,948 A | | 2/1972 | Sherman | |
| 4,451,958 A | | 6/1984 | Robben | |
| 4,589,172 A | | 5/1986 | Hoenigs | |
| 4,656,700 A | | 4/1987 | Tanaka | |
| 4,682,390 A | | 7/1987 | Parrish | |
| 4,813,111 A | | 3/1989 | Nohren | |
| 4,955,115 A | | 9/1990 | Tanaka | |
| 5,115,543 A | | 5/1992 | Fohl | |
| 5,144,725 A | * | 9/1992 | Krauss | 24/625 |
| 5,159,732 A | | 11/1992 | Burke | |
| 5,306,044 A | * | 4/1994 | Tucke | 280/801.1 |
| 5,548,879 A | * | 8/1996 | Wu | 24/625 |
| 5,784,766 A | | 7/1998 | Downie | |

FOREIGN PATENT DOCUMENTS

| | | |
|---|---|---|
| DE | 3535056 | 2/1987 |
| EP | 0131255 | 5/1988 |
| EP | 0368277 | 11/1989 |
| FR | 2553638 | 4/1985 |
| GB | 2151693 | 12/1984 |
| JP | 5278564 | 10/1993 |

* cited by examiner

*Primary Examiner*—Robert J. Sandy
(74) *Attorney, Agent, or Firm*—Dowell & Dowell, P.C.

(57) ABSTRACT

A vehicle body restraint system including a buckle for latching and retaining a latch plate associated with a safety belt wherein the buckle includes a latching mechanism which is moved to a first "locked" position by a threaded component placed under torque to retain the latch plate upon insertion of the latch plate into a buckle housing and wherein release of the latch plate is only permitted upon manual rotation of a pivotal release member which is operatively connected to the threaded component to thereby move the latch plate to a second "release" position. The system is operative such that inertial forces created during vehicle accidents cannot release the latch plate from the buckle housing and such that the torque on the threaded component is automatically increased in the event of an accident resulting in a forward pitch of a vehicle.

27 Claims, 5 Drawing Sheets

NON-INERTIAL RELEASE SAFETY RESTRAINT BELT BUCKLE SYSTEM

FIELD OF THE INVENTION

This invention is generally directed to vehicle safety restraint systems including shoulder and lap-type seat belts and more particularly to such restraint systems which incorporate locking mechanisms for preventing release of latch plates from buckles of the restraint systems due to inertial forces created during vehicle accidents, such as in vehicle rollovers. The restraint systems can only be released by manually maneuvering mechanisms to consciously release the latch plates from the buckles of the restraint systems.

BRIEF DISCUSSION OF THE RELATED ART

Body restraint systems including seat belts, lap belts, shoulder harnesses and the like have been credited with saving numerous lives which otherwise would have been lost in vehicular accidents. The positive benefits obtained in body restraints systems has been so recognized that in the United States the use of seat belts is mandated in all states.

Since their inception, there have been numerous innovative advances made to improve upon the safety and reliability of vehicle body restraint systems. Improvements have been made to the belt and belt materials, the manner in which the belt restraint systems are mounted within vehicles, the manner in which such restraint systems may be automatically adjusted to provide proper tension and ease of adjustment to suit not only safety standards but to also provide for a measure of passenger comfort and further to improve upon the security of the locking devices or belt buckles associated with such systems.

Most conventional vehicle body restraint systems incorporate a belt which either crosses in front of the lap or diagonally across the body of the vehicle operator or passenger in such a manner to not adversely interfere with the region of an individual's neck. Belts are retained by latching assemblies including belt buckles into which latch plates carried by the belts can be inserted so as to automatically become locked to the buckles which are normally anchored relative to frames of vehicles. Conventional systems generally utilize two types of release mechanisms for allowing the latch plates to be removed from buckle housings such that drivers and passengers can disembark vehicles. A first or side release system includes an operating release button which is generally resiliently urged outwardly at an angle which is perpendicular to an axis or line of insertion of the latch plate into a buckle housing. A second type of conventional release system is known as an end release system wherein the operating lever or button for releasing the latch plate from the buckle housing is mounted at an end of the buckle housing.

Currently, virtually all types of latching mechanisms for body restraint systems in automotive vehicles are subject to premature release when subjected to at least one mode of inertial force which can be created under various conditions resulting from collisions, rollovers and other types of vehicle loss of control. Side release latching assemblies or mechanisms, such as referred to as Type 1 and Type 6 in the industry, will inertially release when subjected to lateral forces which are applied to a backside of a buckle during a vehicle collision or rollover. Such latching assemblies will also release by the release button being forceably engaged by an object in a vehicle accidently depressing the button during an accident, collision or rollover, thereby prematurely destroying the effectiveness of the restraint system which can cause severe or deadly injury to the person using the system.

End type release latching systems will inertially release due to the mass of the release buttons associated therewith when taken into consideration the mass of movement of the latch plate and the direction of rotational release of the latch plate when subjected to an upward or upward and lateral force opposite the locking direction of a latch dog associated with such a mechanism, especially during vehicle rollovers. This lateral mode of failure occurs when an occupant is more apt to be ejected from a vehicle and thus can result in severe bodily injury or death.

The above modes of failure are inherent in virtually all conventional side and end release latching mechanisms of conventional vehicle restraint systems. The side release buckle systems are generally simpler and have fewer moving parts and thus are more economical to construct and to install, whereas the end release systems are more complex having multiple moving parts and are thus more expensive to manufacture.

In view of the foregoing, there remains a need to further improve upon the reliability and effectiveness of vehicle body restraint safety belt systems to ensure that the latching mechanisms associated therewith cannot be accidently released during substantially any type of vehicular movement including vehicle rollovers caused during accidents, collisions or resulting from loss of control of a vehicle, such as by operator error or vehicle equipment failure. There is a further need to provide for improvements in vehicle body restraint systems which permit the latching assemblies to be more reliable and more economic to construct.

SUMMARY OF THE INVENTION

The present invention is directed to vehicle body restraint systems which include buckles for latching and restraining latch plates. Several preferred embodiments of the invention will be disclosed. The embodiments are designed to prevent inertial release of safety restraint buckle or latching assemblies associated with vehicles by requiring intentional manual rotation of release mechanisms associated with the buckles to allow release of latch plates associated with the safety belt restraint systems.

In the embodiments of the invention, each safety belt of each restraint system is provided with a latch plate which is insertable so as to be locked and retained within a buckle having internal latching components for engaging and preventing the removal of the latch plate until manually released. Each system includes a belt buckle housing having an opening therein in which the latch plate is slidably received. Mounted interiorly of the buckle housing is a movable locking component which is operable in a first position to engage within an opening in the latch plate to thereby prevent the withdrawal of the latch plate until the locking component is moved from such opening.

In a first embodiment of the invention, the locking component is a latch member which is moved by a latch screw having threads which engage with threads of an opening or hole in the latch member. The latch member is pivotable within a buckle housing and includes a latch dog which is engageable with an edge of the latch plate defining the opening in the latch plate to thereby prevent lateral shifting or withdrawal of the latch plate once it has been inserted within the buckle housing. The latch screw is operatively connected to a pivotal release mechanism such as a knob which can be manually rotated in order to cause pivotal movement of the latch member to release the latch dog from engagement with the latch plate thereby allowing removal or ejection of the latch plate from the buckle housing.

In the first embodiment, a torsion spring is mounted about the latch screw and is secured to the latch screw in such a manner as to supply or apply a constant rotational force to the latch screw in a first direction such that, upon insertion of the latch plate within the buckle housing, the latch member locking dog is urged into engagement with the latch plate as soon as the opening of the latch plate passes the latch dog of the latch member. In this embodiment, the rotational loading of the latch screw torsion spring is caused by manual rotation of a pivotal release member such as a knob which is connected to the latch screw. As the latch screw is rotated, the latch member is moved from the first "locked" position engaging the latch plate to a second "release" position wherein the latch member is moved by the latch screw to permit release of the latch plate of the seat belt system. As the torsion spring is attached to the latch screw, the spring is wound and placed under torsional force as the knob is rotated to release the latch plate.

In the present embodiment, when the latch plate is inserted into the buckle housing, the latch plate will initially engage a locking and ejector mechanism which normally is in a first locking position wherein it retains the latch member in the second or "release" position. As the latch plate is inserted further, the locking and ejector mechanism is moved free of the latch member and, when the latch plate is fully inserted into the buckle housing, the opening therein will pass the latch dog of the latch member thereby allowing the latch member to be moved by the force of the torsion spring such that the latch dog blocks the withdrawal of the latch plate from the buckle housing. As the latch screw is rotated by the torsion spring to urge the latch member into the first "locked" position, the release knob will be rotated such that a locking member on the lower portion of the knob will engage within a detent provided in an outer surface of the buckle housing thereby preventing further rotation of the latch screw. In some embodiments, the locking member associated with the knob or other pivotal member will be operative when the latch member is in either the first "locked" position or the second "release" position.

In the present embodiment, resilient means are associated with the locking and ejector mechanism for automatically ejecting the latch plate upon release of the latch plate upon manually rotation the latch screw by operation of the release knob. The rotation of the release knob rotates the latch screw relative to the latch member thereby driving the latch member in a pivotal motion away from the opening in the latch plate and thereby releasing the latch plate. During this motion, a slide lock of the locking and ejector assembly will block the latch member and retain it in the "release" position.

With the present embodiment, should the latch plate not be inserted fully into the housing, the ejection means, such as spring(s), will automatically eject the latch plate thus ensuring that an individual knows that an appropriate locking engagement has not been made. However, once the latch plate is inserted to a sufficient degree to allow the latch member dog to engage against the edge defining the opening in the latch plate, the locking member associated with the release knob engages in the detent or recess and will have sufficient retaining force to prevent rotation of the latch screw until the release knob is manually rotated releasing the locking member from the recess and rotating the latch screw to pivot the latch member away from the opening in the latch plate.

In another embodiment of the present invention, the latch plate is insertable within an opening in one end of the buckle housing and slides into a passageway of a size to cooperatively receive the latch plate. Extending transversely to the passageway within the buckle housing is a chamber which is defined preferably by linear side walls in which a latch member is slidably disposed. The latch member is movable from a first "locked" position in which the latch member is seated within an opening in the latch plate and thereby prevents release of the latch plate from the buckle housing, to a second position, wherein the latch member is moved free of the opening in the latch plate to thereby permit the automatic ejection of the latch plate. The latch plate is ejected by a resilient member and slide lock which are aligned with the latch plate and which are loaded to provide an ejecting force upon insertion of the latch plate into the buckle housing.

As with the previous embodiment, control of the movement of the latch member to release the latch plate is effected through the intentional manipulation of a pivotal control or release member such as a knob which is mounted on an exterior surface of the housing. The control knob or other pivotal member is operatively connected or secured to a latch screw which is threadingly engaged within an opening within the latch member such that by rotation of the latch screw, a sliding motion is established with respect to the latch member within the latch member chamber.

A torsion spring is mounted about a portion of the housing and has one end anchored thereto and a second end engaged with the release knob or other member such that a constant rotational force or torque is supplied to the latch screw. The latch member is normally retained in a second open or "release" position by the slide lock which is engageable within an opening or slot in the latch member when the latch member is in the "release" position. The slide lock is controlled by the resilient force of the ejection spring associated with the buckle assembly such that, upon insertion of the latch plate within the housing of the buckle, the slide lock is engaged by the tip of the latch plate and urged against the resilient ejection member, thereby moving the slide lock free of the latch member. When the slide lock disengages the latch member, the latch member is free to move axially, guided in a non-rotational movement by the side walls of the latch member chamber. The torsion spring applies a rotational force to the release knob or other pivotal member in a first direction thus creating a rotational force on the latch screw in a first direction and moving the latch member from the "release" position to the "locked" position wherein the latch member is seated within the opening of the latch plate, thereby preventing withdrawal of the latch plate. The torsion spring continues to apply force urging the latch member into the locked position and thus prevents the release of the latch plate in the event of a vehicle rollover or any other type of vehicle movement which is generated by a collision or accident. The only way the latch plate can be released is by manually rotating the release knob or other pivotal member in a second counter direction thereby moving the latch member along a portion of the length of the latch screw and withdrawing the latch member from the opening in the latch plate. The latch member is moved until the opening therein aligns with the slide lock such that the slide lock seats in the opening and retains the latch member in the "release" position. Simultaneously, the release spring will eject the latch plate from the buckle housing. From the foregoing, it can be seen that the torsion spring associated with the present embodiment is placed under force when the release knob or other pivotal member is manually rotated to release the latch plate thereby ensuring that appropriate force is supplied to automatically move the latch member to the "locked" position upon the reinsertion of the latch plate and release of the slide lock from the latch member.

In both the first and second embodiments, it is preferred for the torsion springs and the latch screws to be preloaded, in torque, such that the force against the latch members to urge the latch members to the first "locked position" is in a direction such that any forward pitch of a vehicle adds to the torque thus further forcing the latch members to the "locked" position. Also, the pitch of the threads of the threaded components are such that any foreseeable lateral forces which may act on the safety belt restraint systems during accidents will not cause rotation of the components.

It is the primary object of the present invention to provide vehicle body restraint systems which incorporate latching buckles or assemblies which will not release due to inertial forces which may be encountered when a vehicle is in a collision or accident in which the vehicle may pitch or rollover or be otherwise moved and such that the release of the latch plate of the restraint system can only be accomplished by an intentional rotational movement of a pivotal release mechanism.

It is yet another object of the present invention to provide vehicle body restraint systems which incorporate buckle latching mechanisms or assemblies wherein ejection mechanisms are provided for ejecting the latch plates unless the latch plates have been inserted to a proper degree to positively lock the latch plates within the buckle housings.

It is yet a further object of the present invention to provide locking assemblies for use with vehicle body restraint systems which cannot be accidently engaged and released by objects or inertial forces during a collision or vehicular accident as is the case with the conventional push button-type locking assemblies.

It is also an object of the present invention to provide buckle and latch retaining elements for vehicle body restraint systems which can be economically manufactured and which can be safely used to prevent premature seat belt release in the event of vehicle collisions or other accidents.

BRIEF DESCRIPTION OF THE DRAWINGS

A better understanding of the invention will be had with respect to the embodiments disclosed and with reference to the attached drawings wherein.

DESCRIPTION OF THE PREFERRED EMBODIMENTS

Figure 1:
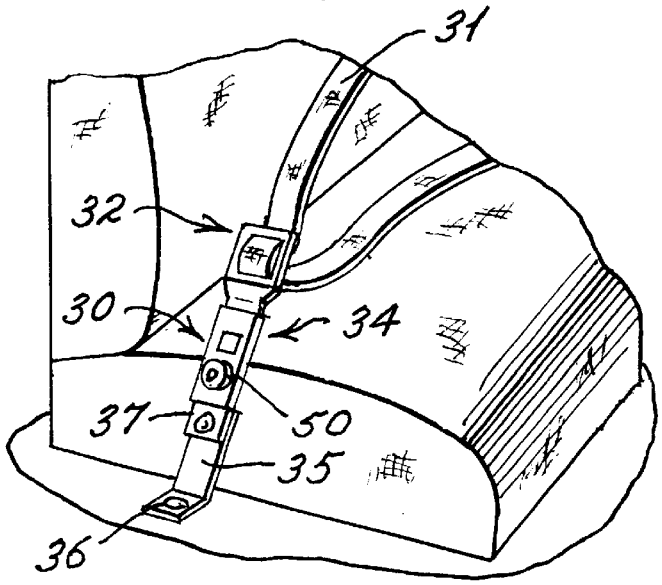
FIG. 1 is a partial perspective illustrational view of a first embodiment of the invention shown as being installed adjacent a vehicle seat.
Figure 2:
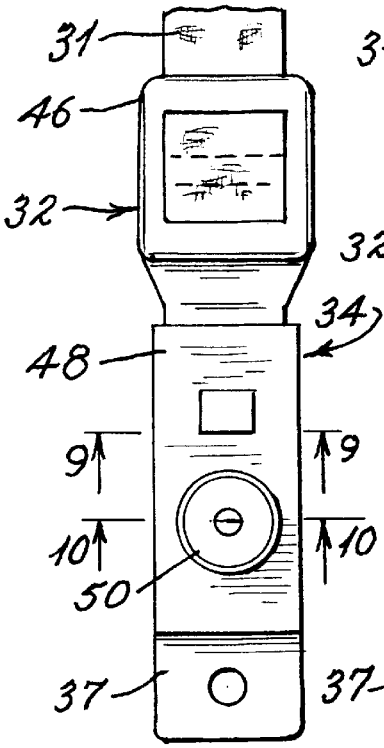
FIG. 2 is an enlarged top plan view of the buckle latching and restraint system in accordance with the first embodiment of the invention.
Figure 3:
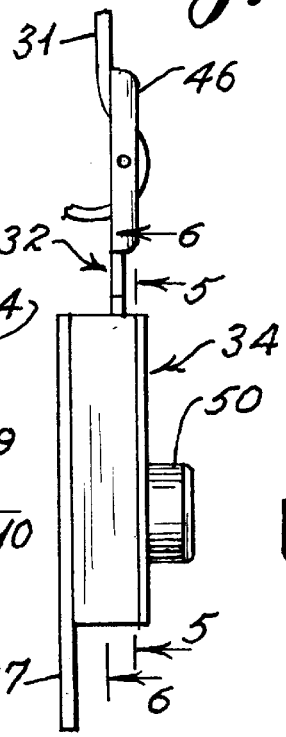
FIG. 3 is a side view of the embodiments of FIGS. 1 and 2.

With particular reference to FIGS. 1–11, a first embodiment of the non-inertial release safety restraint belt system 30 of the invention will be described. The system includes a seat belt 31 which may be a lap belt, a shoulder harness or any other type of conventional belt utilized with safety restraint systems in automotive vehicles, trucks and other types of vehicles for restraining passengers. In the driver side embodiments shown, the belt 31 includes components for crossing the chest of the driver as well as a lap belt portion. The belt 31 is either fixedly secured to or adjustably mounted to a latch plate 32 which is selectively received within a buckle housing 34 which is connected by way of a mounting or base plate 37 to a bracket 35 secured at 36 to a floor or frame component of the vehicle. The buckle need not be secured in this manner but may be used in other systems where the belt may be mounted to a portion of the strap as opposed to a bracket securing the buckle to a vehicle.

Figure 4:
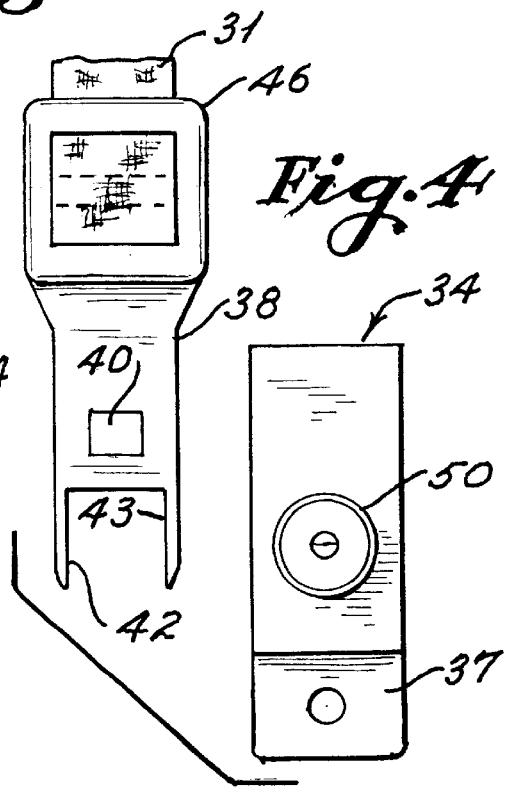
FIG. 4 is a top plan assembly view showing the latch plate of the restraint system of the embodiment of FIGS. 1–3 and the associated buckle housing.
Figure 5:
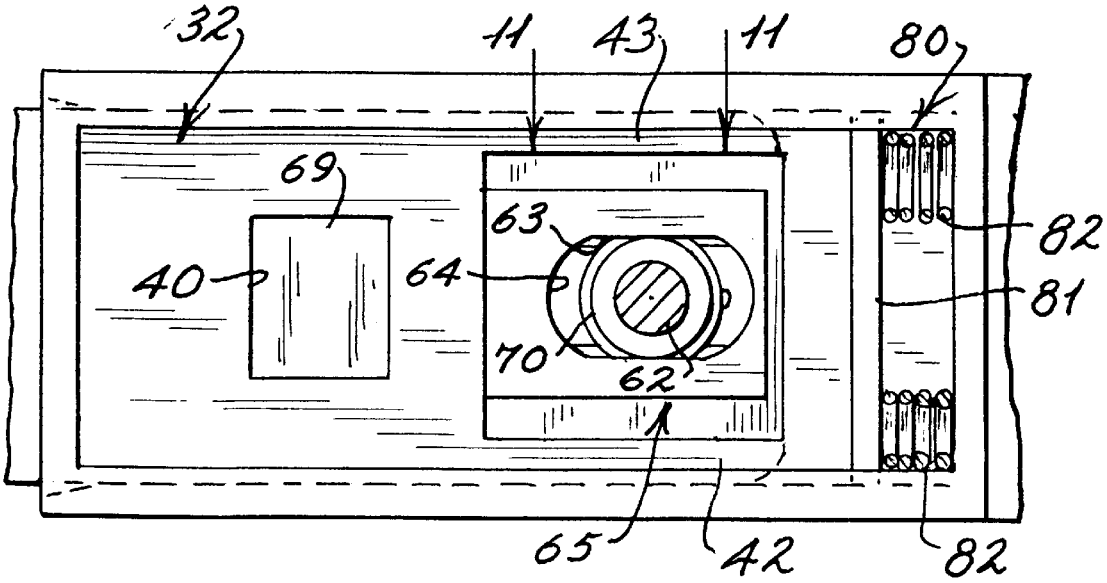
FIG. 5 is an enlarged cross-sectional view taken along line 5—5 of FIG. 3.
Figure 6:
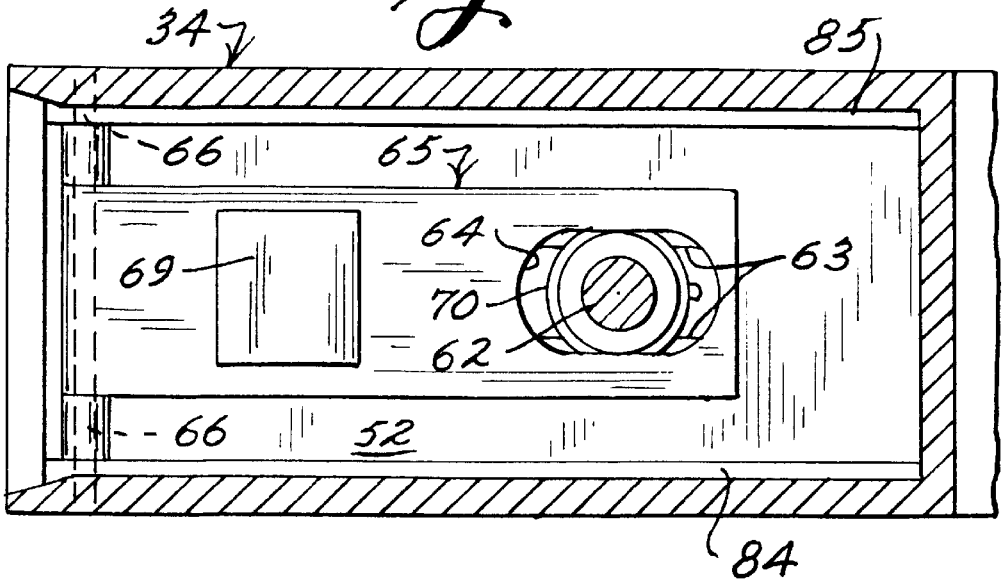
FIG. 6 is an enlarged cross-sectional view taken along line 6—6 of FIG. 3.
Figure 11:
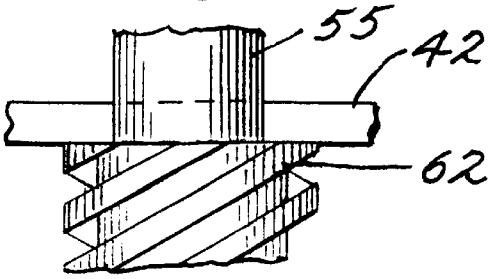
FIG. 11 is a partial cross-sectional view taken along line 11—11 of FIG. 5.

With specific reference to FIG. 4, in the first embodiment of the invention, the latch plate 32 is formed having a generally flat body portion 38 having a latch opening 40 therein which is spaced rearwardly of a pair of forwardly extending prongs 42 and 43 which are spaced to define an open area therebetween. The latch plate further includes a mounting end portion 46 to which the belt 31 is secured.

The buckle housing 34 includes an upper surface 48 on which is oriented a release knob 50, the functioning of which will be described hereinafter. Although a knob is shown in the drawings, the release operating member or mechanism may be in the form of a lever or other device which pivots about an axis.

Figure 7:
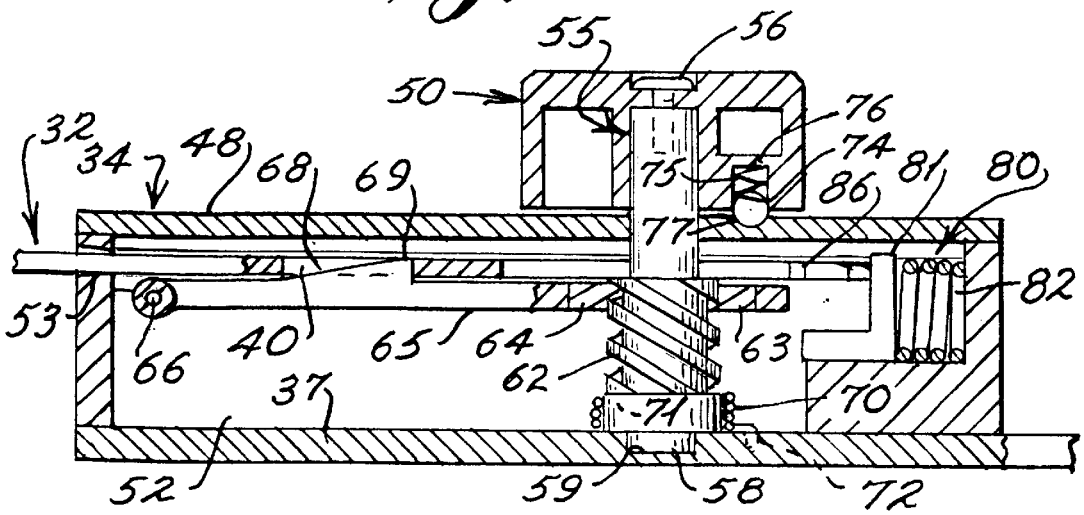
FIG. 7 is an enlarged cross-sectional view taken along line 7—7 of FIG. 2 showing the latch member engaged with a latch plate of this embodiment of the invention.
Figure 8:
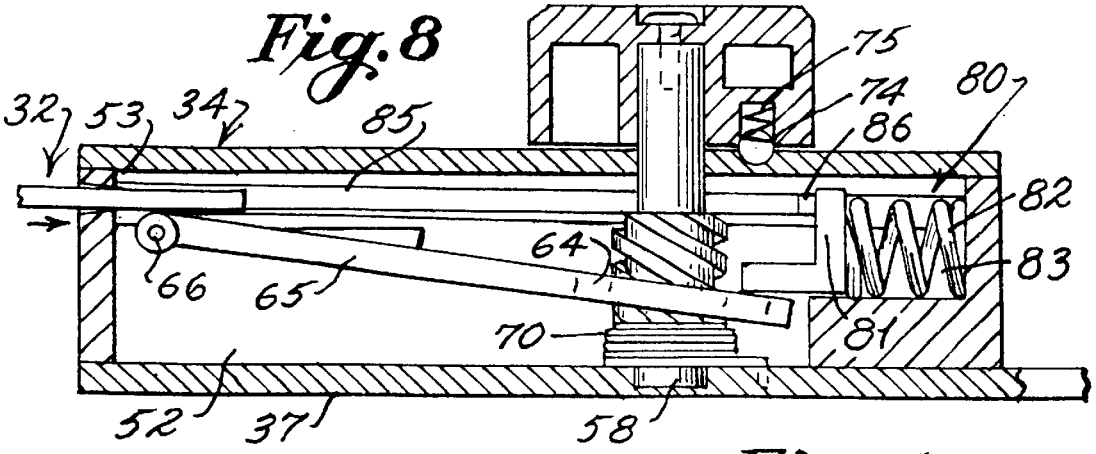
FIG. 8 is a view similar to FIG. 7 showing the latch member moved to a release position with respect to the latch plate of the invention.
Figure 9:
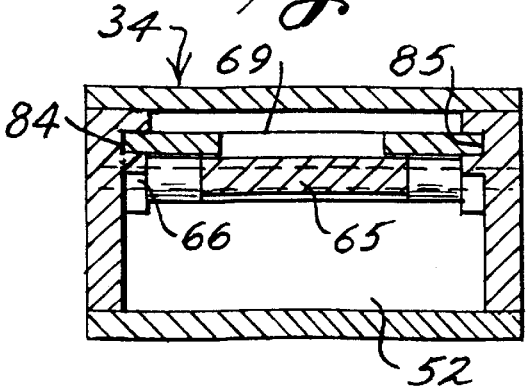
FIG. 9 is an enlarged cross-sectional view taken along line 9—9 of FIG. 2.
Figure 10:
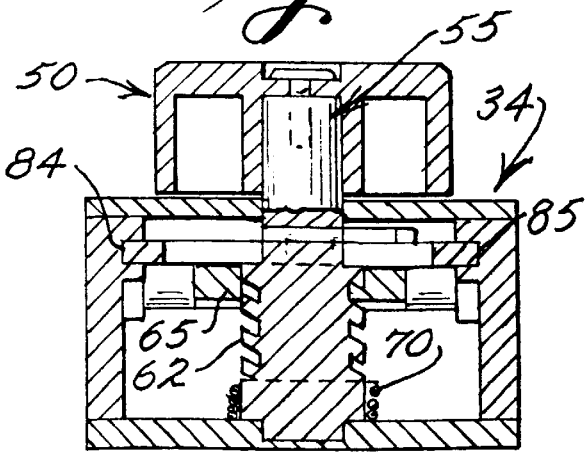
FIG. 10 is an enlarged cross-sectional view taken along line 10—10 of FIG. 2.
Figure 12:
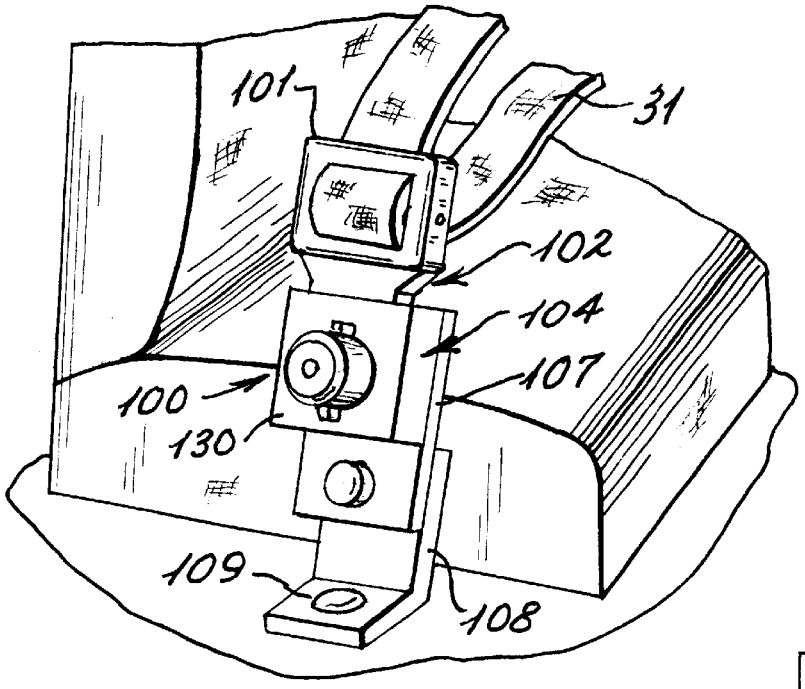
FIG. 12 is a front partial perspective illustrational view of a second embodiment of latch and restraint mechanism of the present invention.

With particular reference to FIGS. 7 and 8, the working components of the buckle assembly of the invention will be described in greater detail. The housing includes an inner chamber 52 which is open at a receiving slot 53 to receive the latch plate 32. The latch plate is shown in FIG. 8 as being initially inserted within the slot 53, being moved in the direction of the arrow toward a latched position within the housing. In FIG. 7, the latch plate 32 is shown as being fully locked and positively retained within the housing.

The release knob 50 is secured to an upper end of a latch screw 55 such as by means of a screw or rivet 56. The release knob 50 may be integrally formed with, connected to or secured by appropriate adhesives or in some other manner to the upper end of the latch screw 55. The latch screw extends into the chamber 52 of the housing 34 to a lower end 58 which is seated within a recess 59 formed in the base plate 37 of the housing. An intermediate portion of the screw is provided with specially formed screw threads 62 which are intermeshingly engageable with opposing screw threads 63 formed in an oblong opening 64 in one end of a latch member 65, see FIG. 6. The latch member 65 is pivoted at its opposite end at 66 adjacent the slotted opening 53 into the housing. The upper surface of the latch member 65 includes a tapering wall surface 68 which terminates at a locking dog edge 69 which is designed to be engageable with an edge of the latch plate 32 defined by the opening 40 therein when the latch plate is in the fully inserted or locked position shown in FIG. 7. The locking dog 69 thereby prevents withdrawal of the latch plate 32 unless or until the latch member 65 is pivoted from the position shown in FIG. 7 to a "release" position, as shown in FIG. 8, wherein the latch member is pivoted so that the locking dog 69 is spaced below the latch plate 32.

A torsion spring 70 is mounted about the base of the latch screw 55 having one end inserted, as shown at 71, within an opening in the screw and an opposite end 72 fixed within an opening in the base plate 60 of the housing 34. In, this manner, a constant rotational force is applied to the latch screw 55 which force is directed to the screw such that the latch member is urged toward the locked position of FIG. 7. The latch member is retained in the release position of FIG. 8 by a slide lock and ejector assembly 80, which when in the position shown, blocks any pivoting movement of the latch member until the assembly 80 is engaged by the latch plate 32 when it is inserted in the buckle housing 34. The spacing between the tips of the prongs 42 and 43 and the opening 40 in the latch plate is such as to insure that, upon initial insertion of the latch plate, the slide lock 81 will initiate compression of ejection springs 82 but will not release the latch member until the opening 40 in the latch plate is aligned to receive the locking dog 69 of the latch member. At this position, and as shown in FIG. 7, the torsion spring will force the latch member to pivot to the locked position.

The slide lock is shown as being of a generally backward L-shape and is movable within an end chamber 83 of the housing. The slide lock is seated in opposing channels 84 and 85 in which the latch plate is guidingly seated. A stop 86 is provided in each channel to limit the movement of the slide lock 81 to the position of FIG. 8 under influence of the ejector springs 82.

The latch member 65 is also retained in the locked position by a detent assembly. As shown in FIG. 7, a locking ball 74 is resilient urged, such as by a spring 75 mounted within a small housing 76 formed in the lower portion of control knob 50, toward a detent or recess 77 provided in the upper surface 48 of the housing. The force of the spring 75 is sufficient to ensure that the latch member cannot be released unless intentional manual force is applied to the release knob 50 to rotate the knob to free the locking ball 74 from the detent 77. During this motion, the latch screw 55 will be rotated and will thus move the latch member 65 to the position shown in FIG. 8 by the meshed engagement of the screw threads 62 and the threads 63 of the latch member. During this motion, further torsional force will be applied to the spring 70, which force urges the screw in an opposite direction of rotation to move the latch member 65 to the locked position of FIG. 7. However, such movement is prohibited by the slide lock 81.

Based upon the foregoing description, upon insertion of the latch plate 32 within the housing through the slot 53, the latch plate will ride within the channels 84 and 85 urging the slide lock against the springs 82 until such time as the locking dog 69 of the latch member 65 aligns with the opening 40 of the latch plate. Thereafter the slide lock 81 clears the latch member allowing the torsion spring to force the latch member to the locked position shown in FIG. 7. In this position, the release knob 50 will have been rotated to the position wherein the locking ball 74 is seated in recess 77 to thereby prevent further rotation of the release knob until intentionally rotated in an opposite direction to compress the torsion spring toward the release position shown in FIG. 8. In the drawings, the locking ball is shown as being seated in the recess 77 when both in the locked and release positions of the latch member shown in FIGS. 7 and 8. Therefore, the latch screw makes one complete 360° rotation between the locked and release positions of FIGS. 7 and 8. A lesser degree of rotation may be created by providing a second recess (not shown) spaced from the recess 77 in which the locking ball 74 can be seated when the knob is rotated to move the latch member to the release position of FIG. 8.

It should be noted that the locking detent assembly shown in the drawing figures can be otherwise constructed such as by providing a reversal of components so that a detent is formed in the base of knob 50 with the spring members being mounted within the housing. Other locks may also be used.

In the present embodiment, the spring constant of the torsion spring 70 is selected such that it will rotate the latch screw to the position shown in FIG. 7 when the slide lock 81 is moved free of the latch member and the opening 40 of the latch plate is aligned with lock dog 49 of the latch member 77. When in the locked position of FIG. 7, the force of the torsion spring 70 is not great enough to cause the ball 74 to disengage the recess 77 unless moved by manual rotation of the release knob 50.

In this respect, when it is desired to release the latch plate 32 from the buckle housing 40, the control or release knob 50 is rotated so as to disengage the locking ball 74 from detent 77 and thereby rotate the latch screw 65 in a direction to move the latch member 65 away from the opening 40 in the latch plate to the position shown in FIG. 8. At this time, the slide lock and ejection spring assembly 80 functions to automatically eject the latch plate from the housing.

With the embodiment shown, the latch release is not subject to inertial forces developed by movement of a vehicle during a collision or other accident, such as when a vehicle rolls over, and, thus, the restraint system cannot be disengaged until manually released. Further, the structure of the latch screw, torsion spring, release knob and the latch member is such that, in the event a vehicle pitches forward during an accident, the momentum or force of such pitch will actually cause an opposite force or torque to be applied to the release knob and latch screw tending to urge the latch screw to drive the latch member toward the "locked" position, thereby increasing the force which retains the latch plate within the buckle housing.

With specific reference to FIGS. 12–19, a second embodiment of the invention is shown in greater detail. In this embodiment, the restraint system 100 is shown as including a driver's side seat belt 31 similar to that as described with respect to the previous embodiment which is secured in a fixed or adjustable manner to a base 101 of a latch plate 102. The non-inertial release safety restraint system 100 further includes a buckle assembly or housing 104 having an upper surface 105 and lower portion 106. The buckle housing 104 is shown as being secured by way of a base plate 107 to a bracket 108 which is mounted by appropriate fasteners 109 to the floor or frame of a vehicle. As previously described, the buckle assembly may be otherwise mounted to an end portion or along the length of a seat belt similar to that shown at 31 and be within the teachings of the present invention.

Figure 15:
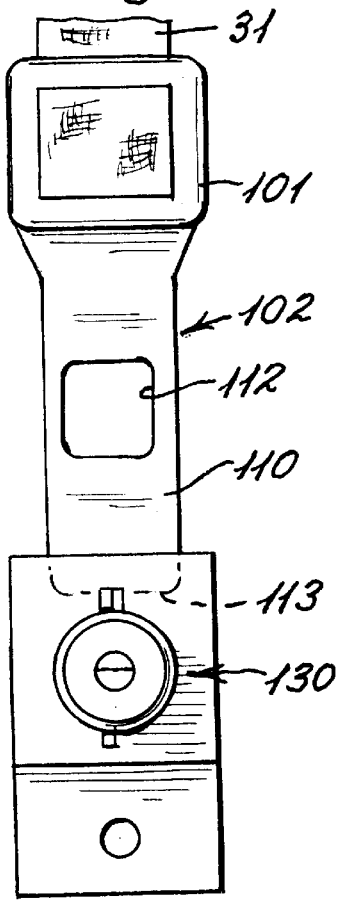
FIG. 15 is an assembly view of the latch plate and buckle housing of the embodiment of FIGS. 12–14.
Figure 13:
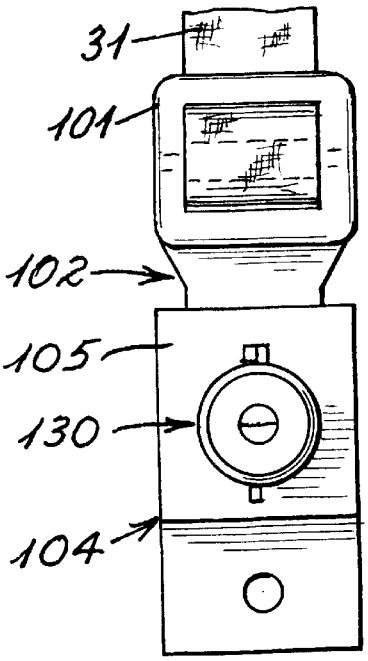
FIG. 13 is a top plan view of the embodiment of FIG. 12.
Figure 14:
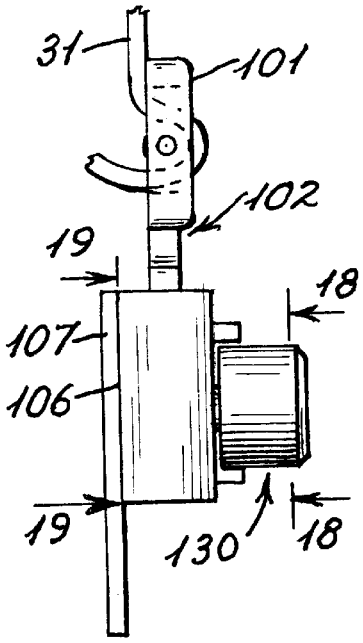
FIG. 14 is a side view of the embodiment of FIG. 12.

As shown in FIG. 15, the latch 102 includes an elongated body 110 having an opening 112 provided therethrough spaced from a forward end 113 thereof.

Figure 16:
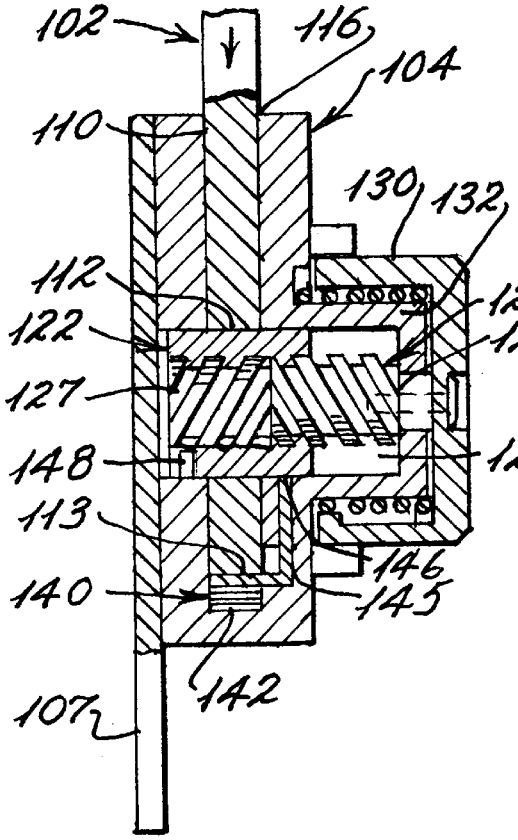
FIG. 16 is an enlarged cross-sectional view taken along line 16—16 of FIG. 13 and showing the latch plate of the embodiment in a locked position.

With specific reference to FIGS. 16 and 17, the working components of the buckle assembly or housing 104 will be described in greater detail. As shown, an elongated passageway 115 is provided in the housing of a size to selectively and cooperatively receive the body 110 of the latch plate 102. The passageway communicates with an opening 116 through which the latch plate 102 is inserted into the housing 104. A latch member chamber including portions 114 and 120 is provided within the housing and extends transversely to and in open communication, on opposite sides of, the passage 115. A latch member 122 is slidably adjustable along the chamber portions 114 and 120 from a first "locked" position shown in FIG. 16, wherein the latch member 122 is shown as being seated within the opening 112 in the latch plate 102 to an offset position as shown in FIG. 18, wherein the latch member is in a second "release" position allowing the insertion and the ejection of the latch plate.

Figure 19:
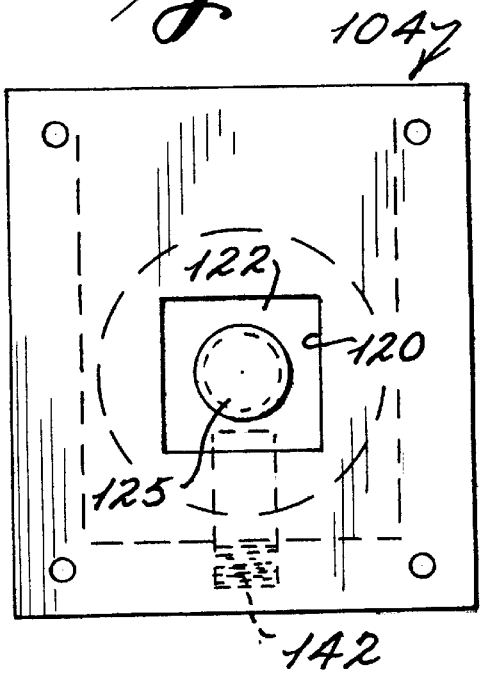
FIG. 19 is an enlarged view taken along line 19—19 of FIG. 14.

With specific reference to FIG. 19, the chamber portions 114 and 120 are generally defined by planar sidewalls, such as in a square configuration, however, other cross sections may be utilized. Also, the configuration could be oval or circular, however, if circular, some means to prevent the rotation of the latch member would have to be provided. The latch member 122 has a matching outer configuration which is shown as being somewhat square or rectangular in the drawing figure. Again, other cross sectional configurations can be used. It is important only to provide a cooperative sliding arrangement between the latch member 122 and the side walls of the chamber 120 which provide for a linear movement without rotation. This is to facilitate the movement of the latch member by way of a latch screw 125 having outer threads 126 which intermesh with female threads 127 provided within the latch member 122. The pitch of the screw threads 126 and 127 is such that foreseeable lateral forces acting on the buckle during accidents will not rotate the latch screw, which is also the case for the threads 62 and 63 of the latch screw and latch member of the previously described embodiment.

The latch screw 125 is secured, such as by a screw 128, to a release knob or other pivotal lever or device 130 which is mounted exteriorly of the housing on a protruded area 132 thereof. Disposed between the inner side walls of the knob 130 and the protruded area 132 of the housing is a torsion spring 134 having a first end 135 seated within a notch 136 in the upper wall 105 of the housing 104 and a second end 137 seated within a recess 138 formed within the inner surface of the release knob 130, as shown in FIG. 18. The torsion spring 134 provides a force tending to rotate the latch screw 125 in such a manner as to cause the latch member 122 to move toward the position of locked engagement with a latch plate 102, as shown in FIG. 16. Further, the threaded engagement between the threads 126 of the latch screw 125 and the female threads 127 of the latch member 122 cause a sliding movement to be obtained with respect to the latch member 122 within the chamber portions 114 and 120 by the relative rotation of the threads. In this manner, whenever the latch plate 102 is inserted within the passage 115 through the entrance opening 116 into the housing 104, and the latch plate is moved to a position in which the opening 112 therein aligns with the chamber portions 114 and 120, the latch member 122 will automatically be resiliently driven by rotation of the latch screw 125 to the seated and locked position shown in FIG. 16.

Figure 17:
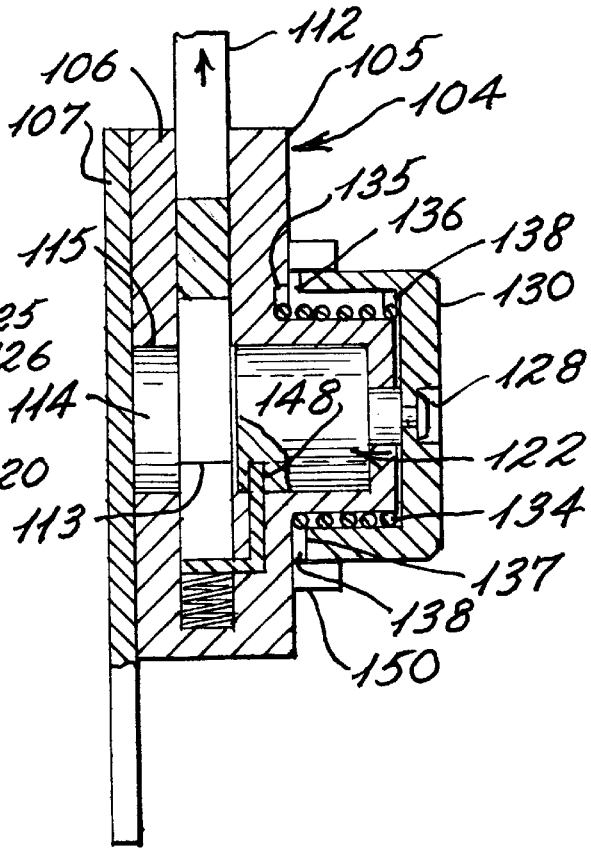
FIG. 17 is a view similar to FIG. 16 illustrating a latch plate in a release position.
Figure 18:
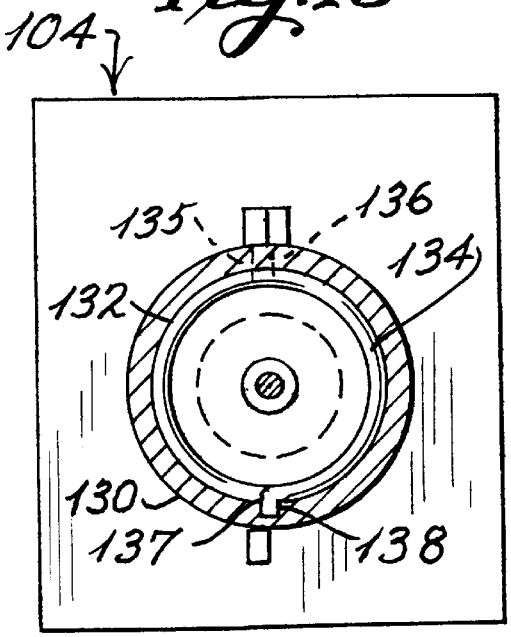
FIG. 18 is an enlarged cross-sectional view taken along line 18—18 of FIG. 14.

The latch member 122 is shown in FIG. 17 in the unlocked or "release" position. As shown in this position, the latch member 122 is fully seated over the threads 126 of the latch screw 125. The movement of the latch member 122 from the locked position of FIG. 16 to the release position of FIG. 17, can only be accomplished by intentional rotation of the release knob 130 and thus cannot be effected by inertial forces which may be created in various types of accidents or collisions involving a vehicle.

By rotation of the release knob 130, the latch member 122 will traverse along the threads 126 of the latch screw 125 until fully withdrawn from the passageway 115. At this time, the latch plate 102 is ejected by an ejection mechanism 140 which is mounted along the innermost portion of the passageway 115. The ejection mechanism includes a spring 142 which is mounted against a slide lock 145 which is shown as being generally "L" shape in configuration. The base of the slide lock 145 is engageable against the forward end 113 of the latch plate 102, such that when the latch member 122 is moved to the release position of FIG. 17, the spring 142 will force the latch out of the passageway 115. Simultaneously, an outer end 146 of the slide lock 145 will engage within an opening 148 provided within the latch member 122, as shown in FIG. 17, thereby preventing the torsion spring 134 from forcing the latch member 122 to the locked position of FIG. 16.

In operation of the embodiment of FIGS. 12–19, upon the insertion of the latch plate 102, the forward end thereof will engage the ejection mechanism 140 compressing the spring 142 and moving the slide lock 145 such that it disengages from the opening 148 in the latch member 122. Thereafter, the force of the torsion spring will rotate the control knob 130 and thus the attached latch screw 125 to thereby move the latch member 122 axially within the chamber portions 114 and 120 to the position shown in FIG. 16 in which it passes through the opening 112 in the latch plate 102 and seats in chamber 114 preventing withdrawal of the latch plate under any adverse conditions. The torsion spring 134 is preloaded such as to provide a torsional locking force to the latch member 122 so that, in the event of a forward pitching motion of a vehicle, an additional locking torque is applied on the screw threads 126 tending to retain the latch member in the "locked" position. When it is desired to release the seat belt, the release knob 130 is rotated in an opposite direction, thereby driving the latch member 122 along the threads 126 of the latch screw 125 until the latch member clears the passageway 115 afterwhich the latch plate 102 is ejected by the ejection mechanism 140.

As shown in the drawing figures, a supplemental set of flanges or a continuous flange 150 may be provided around the base of the release knob to prevent material from penetrating interiorly thereof which might otherwise interfere with the operation of the torsion spring.

The foregoing description has been with respect to two preferred embodiments of the invention. However, the invention is directed to other structures which require an intentional manual rotation to achieve a conscious unlocking movement of a latch member relative to a latch plate within a buckle housing of a seat belt system. Such types of locking mechanisms are not effected by accidental bumps and engagements with objects which may be encountered, especially in an accident situation and are further not effected by inertial forces created by violent vehicle movements such as during a vehicle pitch or rollover.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

I claim:

1. A latch plate and buckle assembly for use with vehicle body seat belt restraint systems including a latch plate having a body portion with a forward end, a rear portion and an opening intermediate said forward end and said rear portion, a buckle housing having an end opening of a size to receive said latch plate, a latch member movably mounted within said housing, an area within said housing for receiving said body portion of said latch plate, said latch member being movable from a first position wherein said latch member is engageable within said opening of said latch plate to secure said latch plate within said housing to a second release position wherein said latch member is spaced from said opening in said latch plate such that said latch plate is releaseable from said housing, means for normally urging said latch member toward said first position including means extending within said housing for engaging said latch member and retaining said latch member within said housing against inertial forces applied against said latch plate and buckle assembly, said means for engaging being operatively connected to a pivotal release member mounted exteriorly of said housing, said means for engaging said latch member preventing movement of said latch member from said first position to said release position by applied inertial forces until manual force is applied to rotate said pivotal release member exteriorly of said buckle housing whereby said latch plate cannot be released from said buckle housing when said latch member is in said first position by inertial forces applied to said latch plate and buckle assembly.

2. The latch plate and buckle assembly of claim 1 including means mounted within said housing for providing a force to eject the latch plate from said housing when said latch member is in said release position.

3. The latch plate and buckle assembly of claim 1 in which said means for engaging said latch member includes a latch screw having threads which cooperatively engage threads carried by said latch member, said latch screw being operatively connected to said pivotal release member whereby upon rotation of said pivotal release member in a predetermined direction said latch member is moved from said first position to said second release position.

4. The latch plate and buckle assembly of claim 3 in which a pitch of the threads of said latch screw and a pitch of the threads of said latch member are such that rotation of said latch screw cannot occur when a force is applied to the latch member tending to force said latch member toward said second release position.

5. The latch plate and buckle assembly of claim 4 in which said means for normally urging said latch member to said first position includes a torsion spring for applying a rotational force to said latch screw, said torsion spring being disposed so as to place a force on said latch screw to move said latch member from said second release position toward said first position.

6. The latch plate and buckle assembly of claim 5 wherein said pivotal release member, said latch member, said latch screw and said torsion spring are so constructed such that in the event of a forward pitch of a vehicle in which the latch plate and buckle assembly is mounted, an increased torque will be placed on said latch screw urging said latch member toward the first position.

7. The latch plate and buckle assembly of claim 5 in which said latch member includes a first end pivotally mounted within said housing and a second end, a threaded opening in said latch member for cooperatively engaging threads of said latch screw, and an engagement member extending from said latch member for seating within said opening of said latch plate when said latch plate is inserted within said buckle housing to thereby prevent withdrawal of said latch plate from said buckle housing.

8. The latch plate and buckle assembly of claim 7 including a slide lock, resilient means for urging said slide lock to engage said latch member to retain said latch member in said second release position, said slide lock being engaged by said latch plate when said latch plate is inserted within said buckle housing to move said slide lock free of said latch member.

9. The latch plate and buckle assembly of claim 8 in which said torsion spring is mounted about said latch screw, and said torsion spring having one end being secured relative to said housing and a second end secured to said latch screw.

10. The latch plate and buckle assembly of claim 8 including locking means associated with said pivotal release member for securing said pivotal release member to said housing when said latch member is in said first position.

11. The latch plate and buckle assembly of claim 10 wherein said slide lock and resilient means for urging said slide lock to engage said latch member constitutes an ejection means within said housing engageable with said forward end of said latch plate when said latch plate is inserted within said housing.

12. The latch plate and buckle assembly of claim 10 in which said pivotal release member includes a release knob, said locking means including a locking detent mechanism associated with said release knob for retaining said release knob in a fixed position when said latch member is in said first position.

13. The latch plate and buckle assembly of claim 5 wherein said area within said housing defines a passageway, said latch member being slidably moveable within a chamber within said housing which extends transversely with respect to said passageway, said latch screw being threadingly engageable with said latch member, the configuration of said chamber and/or said latch member being such that said latch member cannot rotate with respect to said chamber whereby upon rotation of said latch screw, a transverse movement of said latch member is obtained to move said latch member between said first position and said second release position.

14. The latch plate and buckle assembly of claim 13 wherein said pivotal release member, said latch member, said latch screw and said torsion spring are so constructed such that in the event of a forward pitch of a vehicle in which the latch plate and buckle assembly is mounted, an increased torque will be placed on said latch screw urging said latch member toward the first position.

15. The latch plate and buckle assembly of claim 13 including a slide lock mounted within said housing and communicating with said passageway, an opening in said latch member of a size to receive a portion of said slide lock therein, and means for resiliently urging said slide lock into engagement within said opening in said latch member when said latch member is in said second release position.

16. The latch plate and buckle assembly of claim 15 in which said slide lock is engageable by said latch plate when said latch plate is inserted within said passageway of said housing, and said means for resiliently urging said slide lock ejecting said latch plate from said housing when said latch member is in said second release position.

17. The latch plate and buckle assembly of claim 13 wherein said torsion spring is mounted intermediate said pivotal release member and said housing so as to apply a force of rotation from said pivotal release member to said latch screw normally urging said latch screw to rotate relative to said latch member to drive said latch member toward said first position.

18. The latch plate and buckle assembly of claim 5 including a locking mechanism associated with said pivotal release member for retaining said pivotal release member in a fixed position when said latch member is in said first position.

19. A non-inertial release safety body restraint system for vehicles including a latch plate including an opening therein, a buckle housing having an interior passageway for receiving said latch plate, a latch member movable within said housing from a first position engaging said opening in said latch plate to a release position spaced from said opening in said latch plate, means for connecting said latch member to a pivotal release member mounted exteriorly of said housing, said means for connecting being operable upon manual rotation of said pivotal release member to move said latch member from said first position to said release position such that said latch plate may only be released by manual rotational movement of said pivotal release member.

20. The restraint system of claim 19 including means mounted within said buckle housing for normally urging said latch member toward said first position.

21. The restraint system of claim 20 in which said means for urging includes a torsion spring which is placed under additional torque when said latch member is moved from said first position to said release position.

22. The restraint system of claim 19 including means for retaining said latch member in said release position.

23. The latch plate and buckle assembly of claim 19 including a locking mechanism associated with said pivotal release member for retaining said pivotal release member in a fixed position when said latch member is in said first position.

24. A method of providing a non-inertial release safety body restraint system for vehicles which system includes a latch plate having an opening therein, a buckle housing having interior passageway for selectively receiving the latch plate and a latch member movable within the housing from a first position engaging the opening in the latch plate to a release position spaced from the opening in the latch plate, the method including, a. maintaining the latch member in the release position whenever the latch plate is not inserted within the buckle housing, b. moving the latch member from the release position to the first position when the latch plate is fully inserted within the buckle housing to engage the latch plate within the buckle housing, c. locking the latch member in the first position to prevent movement of the latch member to the release position by application of inertial force to the body restraint system, and d. releasing the latch member from the latch plate to allow the latch plate to be removed from the buckle housing only upon the manual rotational movement of a pivotal release member which is connected to operatively move the latch member from the first position to the release position.

25. The method of providing a non-inertial release safety body restraint system of claim 24 including the additional step of normally urging the latch member toward the first position.

26. The method of providing a non-inertial release safety body restraint system of claim 25 including the additional step of providing an ejected force relative to the latch plate whenever the latch plate is fully seated within the buckle housing.

27. The method of providing a non-inertial release safety body restraint system of claim 25 including increasing force to urge the latch member toward the first position in the event a vehicle in which the safety body restraint system is installed develops a forward pitching movement.

* * * * *